United States Patent [19]

Wolcott

[11] 4,226,057

[45] Oct. 7, 1980

[54] SELF-CLEANING INVERTIBLE GUTTER SYSTEM

[76] Inventor: William G. Wolcott, 25 Bramble La., Riverside, Conn. 06878

[21] Appl. No.: 18,942

[22] Filed: Mar. 9, 1979

[51] Int. Cl.[2] ..... E04B 13/00

[52] U.S. Cl. ..... 52/11; 52/16; 248/48.1

[58] Field of Search ..... 52/11, 16, 29; 248/48.1, 48.2

[56] References Cited

U.S. PATENT DOCUMENTS

| | | | |
|---|---|---|---|
| 510,515 | 12/1893 | McKenney | 52/16 |
| 538,108 | 4/1895 | Freeze | 52/11 |
| 4,043,527 | 4/1977 | Franzmeier | 52/11 |
| 4,061,151 | 12/1977 | Ward | 52/16 |
| 4,117,635 | 10/1978 | Nelson | 52/11 |

*Primary Examiner*—James A. Leppink
*Assistant Examiner*—Henry E. Raduazo
*Attorney, Agent, or Firm*—Parmelee, Johnson, Bollinger & Bramblett

[57] ABSTRACT

A self-cleaning invertible gutter system is provided in which a gutter having a projecting downspout connector positioned on the end thereof is mounted on the facia board of a building for roll-over invertible movement thereon. The gutter extends beyond the end of the building with a cooperating downspout being positioned near the corner on the adjacent wall of the building such that the downspout connector is adapted to be swung into and out of the cooperating downspout. A single, continuous support line is attached near the ends of the gutter or near the ends of the facia board and is laced alternately through fixed supports spaced along the facia board above the rear of the gutter and through supports mounted on the lower surface of the gutter and positioned toward the front of the gutter such that this support line passes back and forth around the lower rear corner of the gutter. Alternately, a plurality of spaced individual support lines can be connected to fixed supports spaced along the facia board and to cooperating support means on the gutter such that the support lines extend around the lower rear corner of the gutter at spaced intervals. A plurality of hangers are spaced along the top of the gutter and have raising and lowering lines attached to the front ends of the hangers which flex around the front of the gutter as it rolls over into its inverted lowered position. The raising and lowering lines are coupled to a cascaded pulley system which equalizes the forces on the respective hangers during the raising and lowering operation. As the raising and lowering lines are operated, the gutter rotates and rolls over between the support line and the raising and lowering lines with the downspout connector pivoting and swinging out of or back into the downspout.

The raising and lowering lines and pulley mechanisms may be conveniently positioned indoors in an attic or may be positioned on the facia board itself for outside operation.

7 Claims, 8 Drawing Figures

Fig. 3.
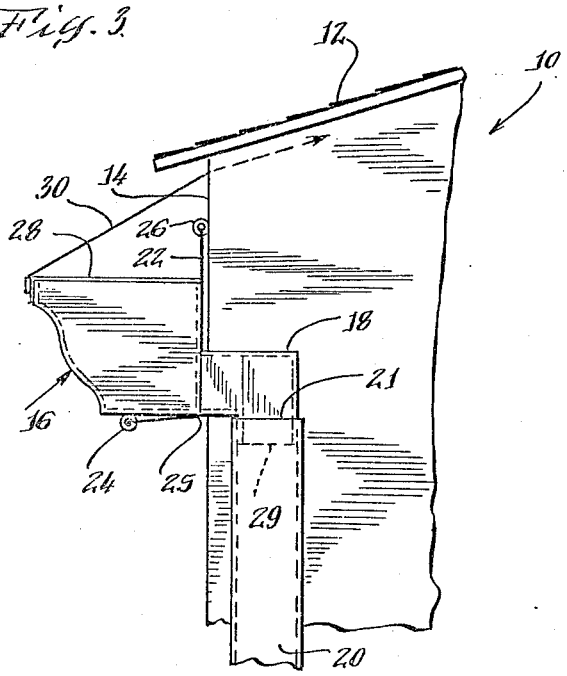
Fig. 4.
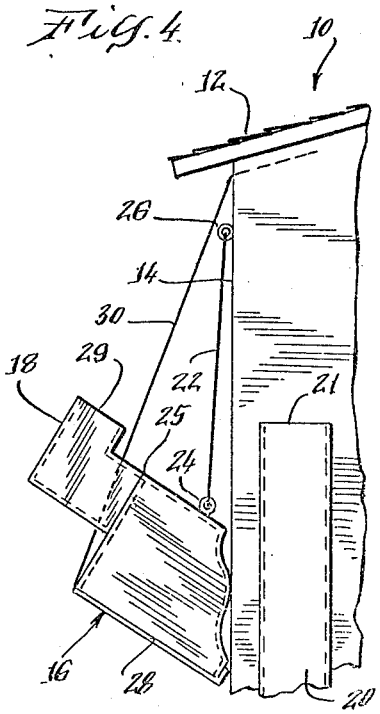
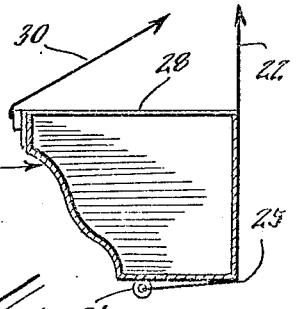
Fig. 5.
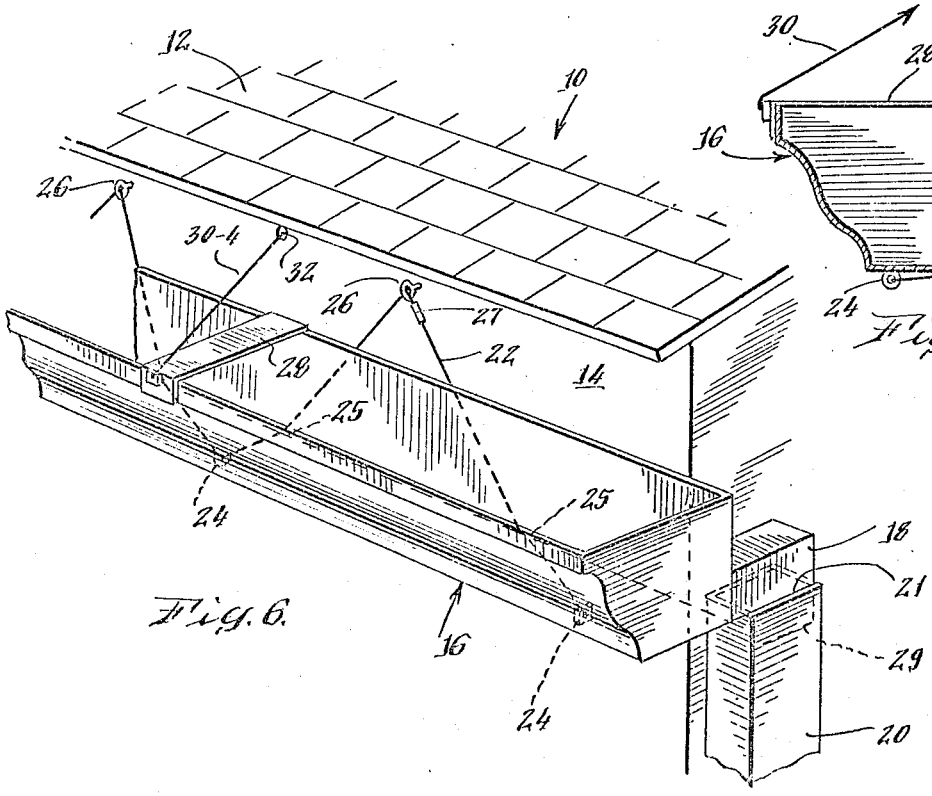
Fig. 6.

SELF-CLEANING INVERTIBLE GUTTER SYSTEM

BACKGROUND OF THE INVENTION

This invention relates to a gutter system for a building, and more particularly to an invertible gutter system which may be rolled over into inverted position at the will of the user, thereby dumping loose debris and leaves which may have accumulated in the gutter or exposing the interior of the gutter so it may be cleaned out from ground level, for example, by a directed jet of water from a watering hose nozzle.

Gutter systems on buildings are hampered by the perennial problem of the accumulation debris, such as leaves, twigs and seed pods, which clog the gutters and hamper their performance in the orderly conduction of water from the roof of the building. The accumulation of such debris clogs the gutters and downspouts, and the water which is normally conducted therethrough overflows down the side of the building which can cause rot and mildew damage.

Various methods have been used for the cleaning of gutters. The most common of which is to do so manually from a ladder or from the roof on which the gutter is mounted, where the roof has a shallow pitch. Both methods can prove to be dangerous to the homeowner. Uneven footing for tall ladders, slippery roofing or loose shingles, and insect's nests, such as hornets and wasps, can make such manual cleaning a hazzardous undertaking.

Screens and other guards have also been mounted over gutters in an attempt to prevent such debris from being deposited therein. However, in actual practice debris still finds its way into the gutters, the screens become clogged or covered over with leaves; they become rusty or otherwise become disconnected from the gutters and certainly hamper any manual attempts to clean the gutters where the screens are clogged or covered over they can cause water to spill down the face of the building or to leak into the building through the eaves.

SUMMARY OF THE INVENTION

It is an object of the present invention to provide a new and novel gutter system which alleviates the aforesaid problems.

A further object of the present invention is to provide a new and novel invertible gutter system which is self-cleaning.

Another object of the present invention is to provide a new and novel invertible gutter system which in its inverted position is exposed to the user at ground level so if necessary it can conveniently be flushed out by standing on the ground and upwardly directing a jet of water into the inverted gutter from the nozzle of a garden hose. There is no need for mounting a ladder or climbing on a roof.

A still further object of this invention is to provide a new and novel self-cleaning invertible gutter system which is easily installed and adjusted for the proper inclination, which is easy to operate, and in which the various forces applied to the gutter by the system are equally distributed.

In carrying out this invention in one illustrative embodiment thereof, a gutter is roll-over mounted on a facia board of a building by supporting lines and raising and lowering lines. The support line is laced alternately through fixed supports on the gutter and facia board passing back and forth around the lower rear corner of the gutter. The raising and lowering lines are attached to the front ends of hangers mounted on the gutters and flex around the front of the gutter as it rolls over into its inverted lowered position. In effect, the support line hinges around the rear of the gutter while the raising and lowering lines hinge around the front of the gutter, thus when the raising and lowering lines are released or pulled, the gutter rotates and rolls over between the support line and the raising and lowering lines. A cascaded pulley system which may be mounted in the attic of the building has the raising and lowering lines attached thereto for equalizing the forces applied across the gutter. Releasing the raising and lowering lines allows the gutter to roll over and move down into an inverted position which dumps the loose debris which has accumulated therein. If the inside of the gutter is still dirty as seen in its inverted position, the interior is exposed so that it may be conveniently and quickly cleaned by a water hose from ground level.

BRIEF DESCRIPTION OF THE DRAWINGS

The invention, together with other objects and advantages thereof, may be best understood from the following description taken in connection with the accompanying drawings, in which:

FIG. 3 is a side elevational view, shown on enlarged scale, of the gutter system of FIG. 1.

FIG. 4 is a side elevational view similar to FIG. 3 but showing the gutter rolled over into its inverted position.

FIG. 5 is a side cross-sectional view of the gutter illustrating the supporting forces exerted on the gutter by the support line and the raising and lowering line.

FIG. 6 is a partial perspective view of the gutter system shown in FIG. 1.

FIG. 7 is a top plan view of the invertible gutter system of the present invention with more of the roof broken away illustrating one form of a pulley system and its mounting in the attic for controlling the raising and lowering the gutter system.

FIG. 8 is a side view illustrating the mounting of the pulley system in the attic on the rafters of the roof.

DESCRIPTION OF THE PREFERRED EMBODIMENTS

Figure 1:
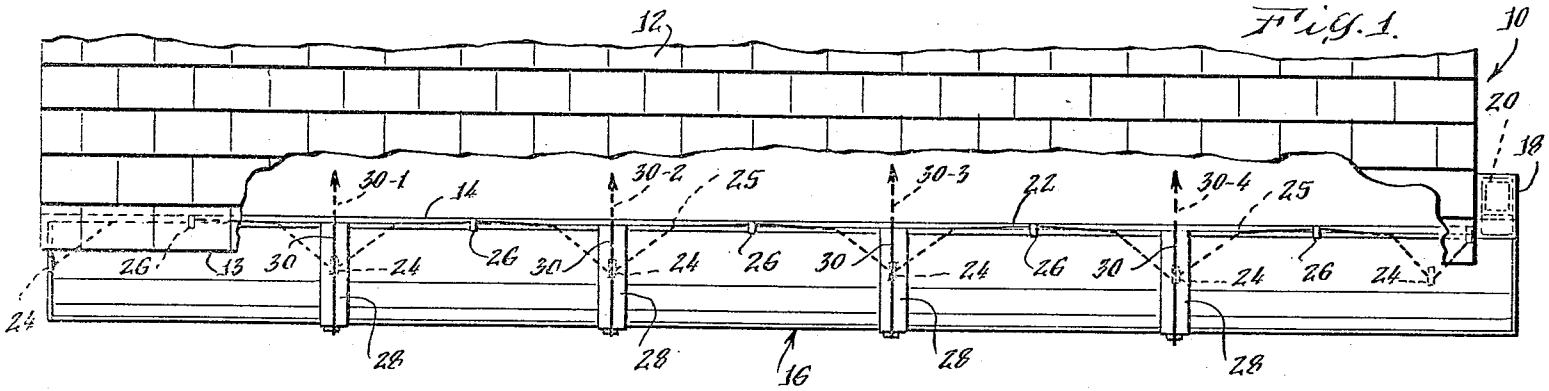
FIG. 1 is a top plan view illustrating one form of an invertible gutter system embodying the present invention with parts of the roof shown broken away.
Figure 2:
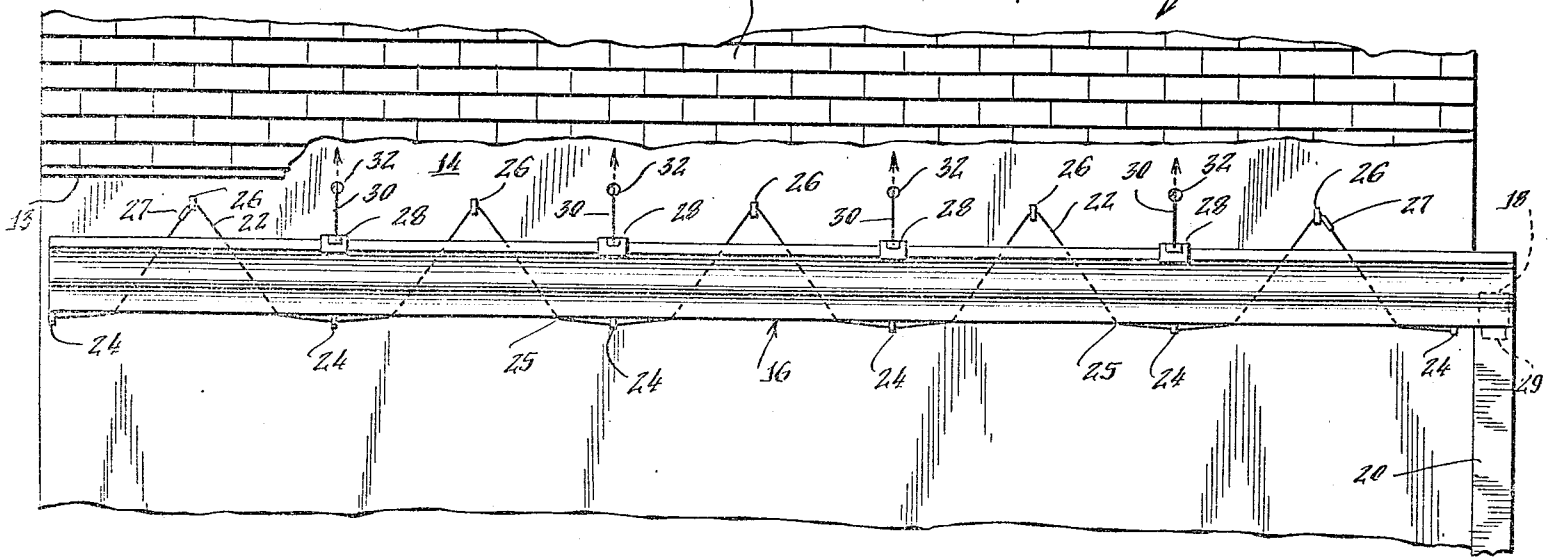
FIG. 2 is a front elevational view of the invertible gutter system of FIG. 1.
Figure 9:
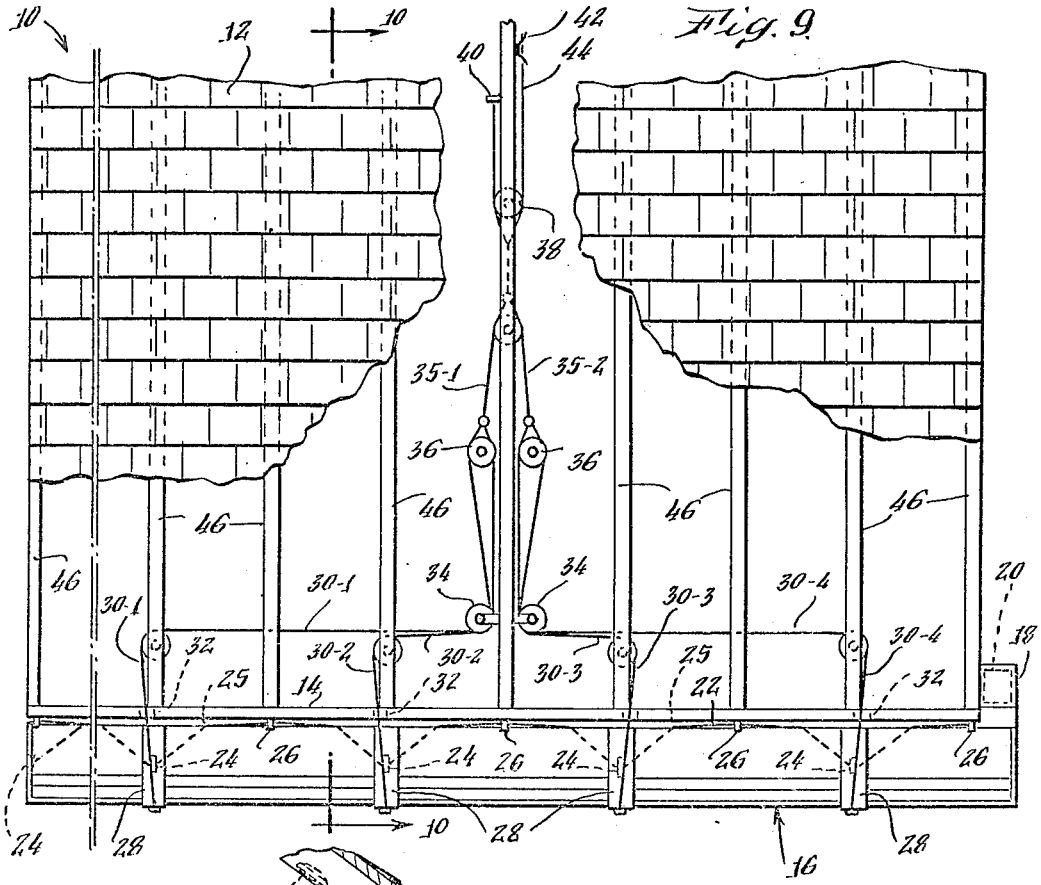
Figure 10:
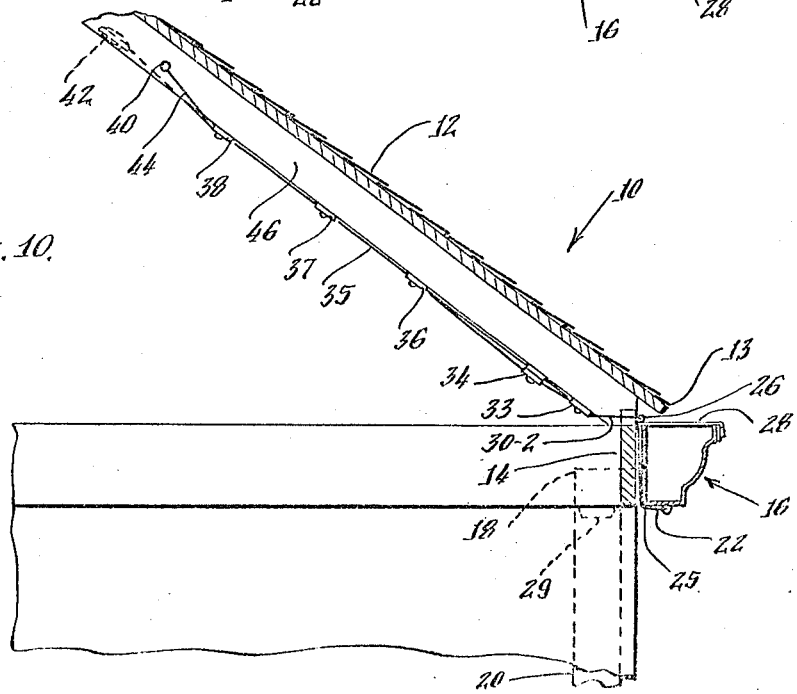

Referring now to FIGS. 1 and 2, one form of an invertible gutter system is illustrated in accordance with the present invention, with the gutter 16 mounted on a facia board 14 of a building 10 under the eave 13 of a roof 12. The gutter 16 extends to the right beyond the end of the facia board 14 and has a horizontally projecting downspout connector 18 which extends along near the adjacent wall at the corner of the building (See FIG. 3). This connector 18 can feed into a downspout or leader 20 which is mounted on the adjacent wall of the building immediately around the corner instead of the usual positioning directly under the gutter.

The gutter 16 in FIGS. 1 and 2 is shown held in an upright position by a supporting line 22 which is laced in zig-zag fashion and a plurality of raising and lowering lines 30. FIG. 5 illustrates the forces exerted on the gutter 16 by the lines 22 and 30, thereby normally holding the gutter firmly against the side of the building in an upright position.

Each end of the support line 22 is attached to supports 24 near the ends of the gutter. Alternatively the ends of this support line may be attached to fixed supports 26 near the ends of the facia board 14. A plurality of such fixed line supports or guides 26 are mounted on the facia board at longitudinally spaced points above the gutter 16 and other supports or line guides 24 are mounted on the forward bottom portion of the gutter. The supports or line guides 24 and 26 are shown in the form of eyes. The supports 26 may be screw eyes which are driven into the facia board. The support line 22 is alternately laced through the support guides 26 (See FIG. 6) on the facia board and the supports 24 on the bottom of the gutter passing back and forth in a zig-zag pattern around the lower rear corner 25 of the gutter 16.

A plurality of strap-like hangers 28 are positioned in spaced relation extending across the top of the gutter 16. A plurality of raising and lowering lines 30 are attached to the front ends of the hangers 28 and flex around the front of the gutter as it is raised and lowered. The raising and lowering lines 30 extend through small openings 32 into the attic under the roof 12.

The supporting line 22 which is laced through the line guides or supports 24 and 26 on the facia board and on the bottom of the gutter serve to support the gutter at these points. This lacing of the line 22 equalizes the support force at each line guide or support point both on the facia board and on the bottom of the gutter. The supporting line 22 also acts as a hinge at the corner 25 around which the gutter rotates and then rolls over into its inverted position as seen in FIG. 4. The lacing arrangement illustrated in FIGS. 1 and 2 advantageously allows for the adjustment of inclination of the gutter 16 to the proper pitch so that water deposited therein runs toward the downspout connector 18.

This adjustment is accomplished by initially mounting the gutter 16 on the line 22 in a generally level position. The right end of the gutter 16 is then lowered by moving the gutter end down as the laced line moves through the intermediate line guides 24 and 26. When the gutter is at the correct inclination to allow the water to run towards the downspout, a pair of cable clamps 27 are squeezed around the line 22 next to the outside guides or supports 26 on the facia board as illustrated in FIGS. 2 and 6. The line clamps 27 then permanently hold the gutter 16 at the correct inclination.

In place of the single line 22 in the lacing arrangement shown and described a plurality of spaced fixed supports may be positioned on the facia board above the gutter 16 and vertically aligned with supports on the forward underside of the gutter. Then, a plurality of individual vertical support lines are mounted thereon such that each of the supporting lines extends down from the support on the facia board around the lower rear corner 25 of the gutter to the support near the bottom front of the gutter. With this arrangement of the multiple individual support lines the adjustability of the inclination of the gutter is not feasible. Thus, the individual support lines must be of appropriate length for holding the gutter inclined down slightly toward the downspout.

FIGS. 3 and 5 illustrate the gutter being held in its upright position by the pull of the taut raising and lowering lines 30. Accordingly, the gutter is held firmly in its upright position as shown in FIGS. 3 and 5. As soon as the pull exerted by the lines 30 is released, the gutter 16 rotates around the rear corner 25 and rolls down and over to the inverted position shown in FIG. 4. In this movement the downspout connector 18 swings and rises out of the upper end 21 of the downspout 20 as shown in FIG. 4. When the gutter is again raised by applying a suitable pull on the lines 30, the downspout connector 18 swings clockwise retracing its downward path and resumes its normal position with its mouth 29 nesting in the top 21 of the downspout as shown in FIG. 3.

FIG. 7 illustrates one arrangement of raising and lowering mechanism in the form of a cascaded division pulley system for equalizing the forces on the lines 30. FIG. 7 also illustrates mounting the raising and lowering mechanism in the attic.

The raising and lowering mechanism comprises a plurality of stationary pulleys 33 which are illustrated as four in number so that there is one stationary pulley for each line 30. The lines 30 from the stationary pulleys 33 run to four stationary pulleys 34 and the lines 30 run around two movable pulleys 36. The movable pulleys 36 are connected by equalizing lines 35 which run around a movable pulley 37 which is attached to or coupled to a movable pulley 38. An operating line 44 is anchored at one end 40 and extends around the movable pulley 38 and is normally secured at the other end to a cleat 42 which is located at a conveniently accessible place in the attic. The movable pulley 38 provides a mechanical advantage of two for the operating line 44.

If it is desired to have additional mechanical advantage for the operating line 44, the movable pulley 38 may be replaced by one having multiple sheaves, and an anchored pulley (not shown) may be located near the cleat 42. Then the line 44 is run through these pulleys to provide the desired mechanical advantage.

For inverting the gutter, the operating line 44 is released from the cleat 42, the moving pulleys 36, 37 and 38 all move toward the facia board 14, thereby allowing the lines 30-1, 30-2, 30-3 and 30-4 to move for allowing the gutters 16 to drop to the inverted rolled-over position illustrated in FIG. 4 in which the trough-like interior 50 can be seen and is accessible for a hose spraying. For raising the gutter back to its normal position, the operating line 44 is pulled tight. Equal forces are exerted by the movable pulley 37 on the two portions 35-1 and 35-2 of the line 35. Thus, the force exerted by each of the two portions 35-1 and 35-2 of the line 35 on the two movable pulleys 36 is equalized. Similarly, the left movable pulley 36 exerts equal forces on the two portions 30-1 and 30-2 of the left raising and lowering line 30, while the right movable pulley 36 exerts equal forces on the two portions 30-3 and 30-4 of the right raising and lowering line 30. Consequently, the forces exerted by all of the line portions 30-1, 30-2, 30-3 and 30-4 on the respective hangers are equalized. The lines 30-1. 30-2, 30-3 and 30-4 exert force equally on the four hangers 28, and the gutter 16 is rolled up into an upright position and held tightly against the facia board 14 with equal force being applied at the four connection points on the respective hangers. The operating line 44 is then secured around the cleat with the gutter held firmly in its upright position.

As illustrated in FIG. 8, the hoisting mechanism may be positioned on the rafters 46 of the roof 12. If a building has a knee wall, the hoisting mechanism may be positoned along the knee wall or in the space behind the knee wall, or may be positioned on any suitable supports in the attic. Furthermore, if necessary the hoisting system may be mounted along the facia board on the exterior of the building. It should be appreciated that different types of hoisting systems may be utilized with the principle objective of such a system being to equalize the forces or pull on the respective lines 30-1, 30-2, 30-3 and 30-4 when the gutter is hoisted and secured in place. These raising and lowering lines function to raise and lower all sections of the gutter simultaneously. With the proper hoisting mechanism as explained, the respective lines 30-1, 30-2, 30-3 and 30-4 exert equal force at the four hanger points at all times during the raising and lowering operation.

As illustrated, this is accomplished by equalizing the forces at two hanger points by connecting them with a line which passes through a first moving pulley 36. The same is done with two other hanger points and the forces on the two moving pulleys are then equalized by passing the line which connects the two moving pulleys around another moving pulley 37. Thus, equal forces are always transmitted to the four hanger points. The lines 30 hold the inner side of the gutter firmly near the facia board with the support line 22 positioned therebetween, which permits circulation of air and allows moisture to be released from between the back of the gutter and the facia board. The lines 30 also flex freely around the top rear corner 48 of the gutter as it rolls over in its descent to the inverted position shown in FIG. 4.

Thus, quickly and easily by releasing an operating line 44, a gutter may be inverted, and the loose debris which has been accumulated therein falls out. At the same time, in its inverted position, the interior of the gutter is conveniently exposed and can be viewed from the ground. Accordingly, the gutter may be cleaned from the ground using a garden hose. After cleaning the gutter is then hoisted and securely held to perform its normal function.

If it is desired to provide eight hoisting and lowering lines for a long gutter, the forces in these eight lines are equalized by connecting the four line portions 30-1, 30-2, 30-3 and 30-4 respectively to four movable pulleys each of which is in turn arranged to pull equally on two portions of a hoisting and lowering line. In other words, the arrangement shown in FIG. 7 is cascaded by using four more movable pulleys.

If no mechanical advantage is desired for the operating line 44, then one of its ends may be connected directly to the movable pulley 37, thereby eliminating the movable pulley 38.

The flexible lines 22, 30, 35 and 44 may be ropes which are laid or braided of synthetic polymeric material, for example such as Nylon, polyester, polypropylene and the like. If desired, the flexible lines 22 and 30 may be flexible stranded stainless steel wire cables having a diameter of approximately 1/16 to 3/16 of an inch in diameter.

Since other modifications and changes varied to fit particular operating requirements and environments will be understood to those skilled in the art, the invention is not considered limited to the examples chosen for purposes of illustration and covers all changes or modifications which fall within the true spirit and scope of the following claims.

What is claimed is:

1. An invertible gutter system comprising:

(a) a straight length of gutter having a trough-like interior;

(b) a plurality of lengths of supporting line attached to the side of the building at spaced points above the location of the gutter;

(c) said lengths of supporting line extending down near the side of the building and each being attached to a lower portion of the gutter;

(d) a plurality of lengths of hoisting and lowering line attached to the top of the gutter near the front of the gutter and extending diagonally upwardly toward the building for holding the gutter upright near the side of the building in normal operating position when said lengths of hoisting and lowering line are pulled taut; and (e) operating mechanism attached to the building for pulling said lengths of hoisting and lowering line taut and for loosening said lengths of hoisting and lowering line when it is desired to lower the gutter into an inverted position;

whereby loosening of said lengths of hoisting and lowering line allows said gutter to roll down and over into an inverted position in which debris is dumped from the gutter and in which the trough-like interior of said inverted gutter can be viewed by a person standing on the ground, thereby to enable the interior of the gutter to be flushed out if necessary by a jet of water from the nozzle of a garden hose.

2. An invertible gutter system as claimed in claim 1, in which:

said lengths of supporting line are attached to the bottom outside of the gutter to respective points of attachment near the front of the gutter; and when said gutter is in its normal upright position said lengths of supporting line extend down near the side of the building and flex around the bottom rear of the gutter and then extend forward to said points of attachment;

loosening of the lengths of hoisting and lowering line allows said gutter to roll down and over into an inverted position in which said lengths of supporting line have become unflexed and extend directly from said points of attachment on the side of the building to said points of attachment on the outside bottom of the inverted gutter, and in which said lengths of hoisting and lowering line have become flexed around the top rear of the inverted gutter.

3. An invertible gutter system as claimed in claim 1 or 2, in which:

a plurality of fixed line guides are mounted on the building above the location of said gutter, being positioned at spaced points along the length of the gutter; and a plurality of gutter line guides are mounted on the lower portion of the gutter, being positioned at spaced points along the length of the gutter;

said supporting line is a continuous line laced in generally zig-zag fashion providing said lengths thereof passing alternately through said fixed line guides and through said gutter line guides, whereby the inclination of the gutter with respect to the horizontal can be adjusted for proper drainage after the gutter has been attached to the building by sliding said supporting line through the respective line guides and thereafter the gutter can be secured at the desired inclination by securing the supporting line against such sliding.

4. An invertible gutter system as claimed in claim 1 or 2, in which:

said straight length of gutter has an end projecting slightly beyond a corner of the building;

a downspout is mounted on the adjacent side of the building near said corner and having an open top end;

a downspout connector is mounted on said projecting end of the gutter and has a mouth nesting in said open top end of the downspout when the gutter is in its normal upright position; and said downspout connector swings away from the top of the downspout when the gutter rolls over into said inverted position.

5. A self-cleaning invertible gutter system which is mounted on the side of a building comprising:

(a) a straight length of gutter having a trough-like interior and a downspout connector positioned on one end thereof adapted to be moved with respect to a cooperating downspout, (b) a first plurality of supports spaced along on the lower outside of said gutter near the front of the gutter, (c) a second plurality of fixed supports spaced along on the side of the building above said gutter, (d) a plurality of lengths of support line coupled between said supports on said gutter and on said side of the building, (e) a plurality of lifting and lowering lines spaced along and attached to the front of said gutter, and (f) and means for actuating said lifting and lowering lines in unison for holding said gutter upright near said side of the building when said lifting and lowering lines are taut or for inverting said gutter when released, whereby the inversion of said gutter causes loose material which has been accumulated therein to be released and exposes the trough-like interior of said gutter from ground level so that it may be washed out using a hose.

6. The gutter system set forth in claim 5 wherein said supports on said gutter on said side of the building are staggered, and lengths of said support line are one continuous line which is alternately laced between said respective supports.

7. The gutter system set forth in claims 5 or 6 wherein said means for actuating said raising and lowering lines comprises a cascade division pulley system which equalizes the force exerted on said raising and lowering lines.

* * * * *